US005918323A

United States Patent [19]

Smith

[11] Patent Number: 5,918,323

[45] **Date of Patent: *Jul. 6, 1999**

[54] HOSPITAL LIQUID SANITATION CART

[76] Inventor: Anthony Smith, P.O. Box 1168, Tampa, Fla. 33601

[ * ] Notice: Under 35 U.S.C. 154(b), the term of this patent shall be extended for 33 days.

[21] Appl. No.: 08/506,851

[22] Filed: Jul. 25, 1995

[51] Int. Cl.[6] ..... A61J 19/04

[52] U.S. Cl. ..... 4/262; 4/516; 4/625

[58] Field of Search ..... 4/262–266, 516–518, 4/621, 625–627, 645, 646, 650

[56] References Cited

U.S. PATENT DOCUMENTS

| | | | |
|---|---|---|---|
| 1,424,272 | 8/1922 | Ankney | 4/262 |
| 3,192,537 | 7/1965 | Coffman et al. | 4/516 |
| 4,072,157 | 2/1978 | Wines et al. | 4/625 X |
| 5,014,371 | 5/1991 | Heel | 4/645 X |
| 5,117,511 | 6/1992 | Smith | 4/114.1 |

FOREIGN PATENT DOCUMENTS

| | | | |
|---|---|---|---|
| 0569966 | 4/1924 | France | 4/516 |

*Primary Examiner*—Charles E. Phillips
*Attorney, Agent, or Firm*—Charles A. McClure

[57] ABSTRACT

Mobile hospital liquid sanitation cart for convenient and safe collection and ready transport and disposal of liquid waste from patients. A cuplike receptor on flexible tubing is extended to receive waste liquid and convey it to temporary storage in the cart. Rinse liquid is provided to the receptor to wash down the waste liquid and also is available to wash down the waste storage when at a suitable discharge location, as over a toilet bowl or other drain.

3 Claims, 2 Drawing Sheets

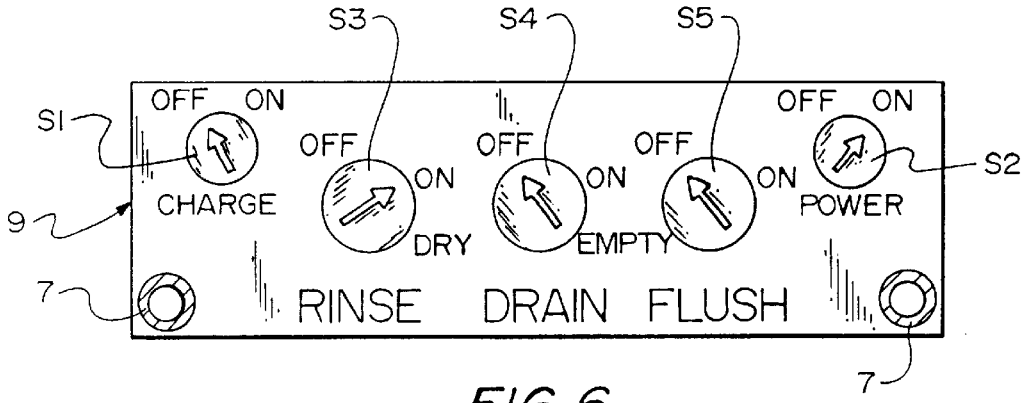
FIG. 6
FIG. 7
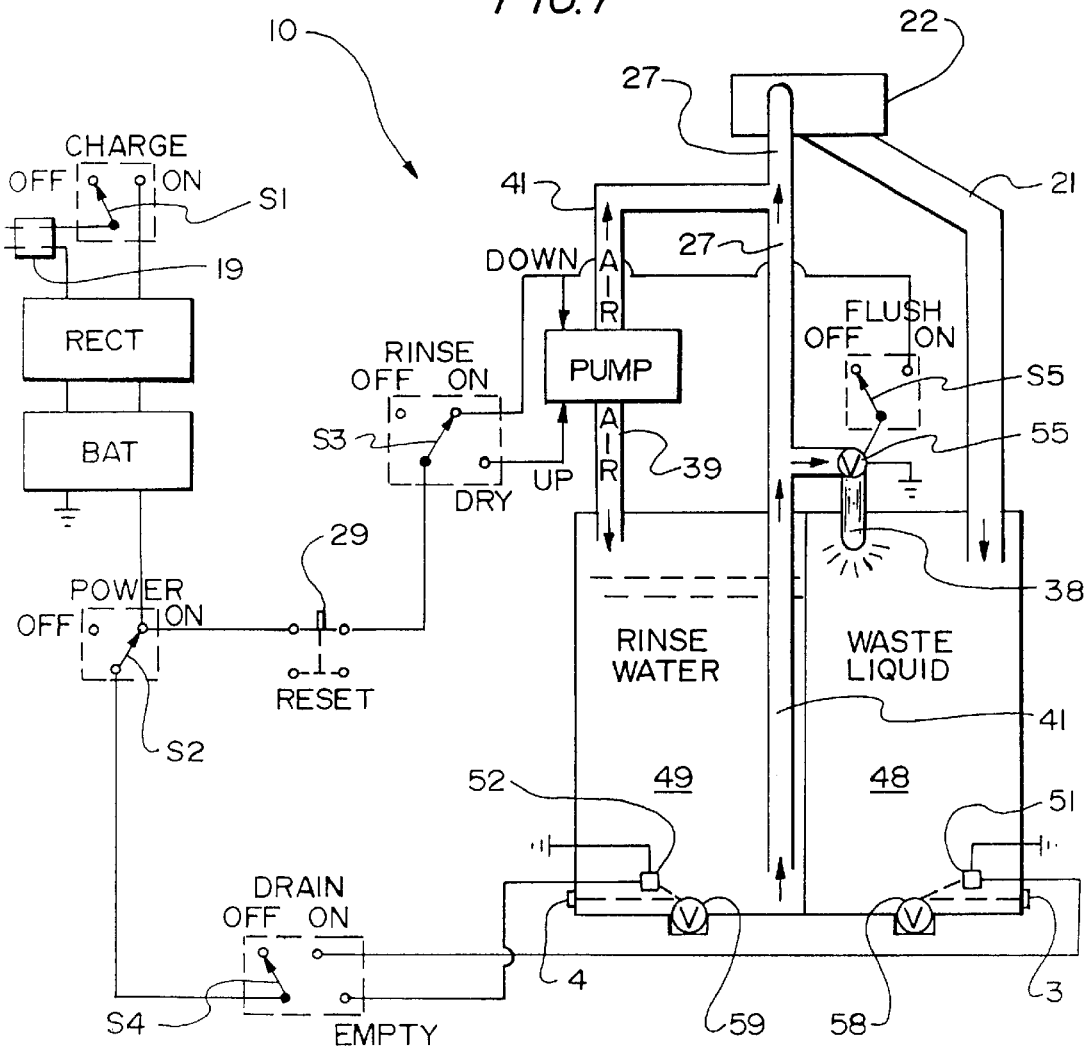

HOSPITAL LIQUID SANITATION CART

TECHNICAL FIELD

This invention relates to cartlike sanitation apparatus adapted to receive liquid waste, as from hospital patients, for transport to a nearby disposal site for draining discharge.

BACKGROUND OF THE INVENTION

Whoever goes to a dentist's office for treatment is acquainted with the chairside bowl into which patients relieve themselves of excess saliva (and blood) occasioned by the dentist's ministrations. Such waste liquids are flushed away through concealed plumbing to a conventional sanitary drain, to which people give little thought, at least so long as everything is operating satisfactorily. At home, there may be various outlets nearby for waste liquids. However, if a person is immobilized in bed, whether at home or in a hospital, such an outlet or immediate assistance may be unavailable. There is a substantial, even critical, need for sanitary successors to such portable items as liquid-soaked tissues and fabrics or liquid-filled spittoons, cups, bedpans, and the like—which at best necessitate additional transporting (also cleaning if intended to be reusable).

Attempts by others to meet this need have failed to do so. U.S. patentees have proposed such devices as piped-in non-portable sanitary cuspidors, by Walker in U.S. Pat. No. 1,046,911 and Korten in U.S. Pat. No. 1,231,385, and similar funnel-like receptor means by Otte in U.S. Pat. No. 3,965,006; and a temporary holding tank above a toilet by Sevigny in U.S. Pat. No. 4,823,428. The present inventor's disclosure—in his U.S. Pat. No. 5,117,511—of liquid disposal means installed in a motor vehicle predisposed him to give serious consideration to the need for related means in hospitals.

Wherever potential users do not have ready access to a piped-in waste liquid receptor, the earlier mentioned portable containers are commonly used despite the trouble of transporting and cleaning them. The present invention is intended to meet the need for sanitary collection and disposal of waste liquid conveniently and effectively, while avoiding the impracticalities of those alternative practices.

SUMMARY OF THE INVENTION

A primary object of the present invention is to eliminate handcarried materials in disposal of liquid waste from persons unable to reach a built-in sanitary receptor for such waste.

Another object of this invention is to provide mobile temporary repository means to bridge spatial separation between liquid waste source and disposal sites.

A further object of the invention is to provide such mobile temporary repository means with readily positionable receptor means for receiving personal waste liquid.

Yet another object of this invention is to provide rinse water to such receptor means from a supply in the temporary repository means and to collect used rinse water along with the liquid waste.

A still further object is to discharge waste liquid from such temporary repository means at will into a toilet or other external disposal site.

In general, the objects of this invention are attained by collecting waste liquid plus rinse water from persons at one or more sites, temporarily retaining the resulting composite waste liquid, and transporting the same to a disposal site and flushing it there.

More particularly, these objects are accomplished by providing mobile sanitation apparatus having not only temporary retention means for waste liquid, but also readily positionable waste liquid receptor means flexibly connected to the retention means to collect waste liquid, plus a supply of water to rinse the receptor means, and with bottom drain means to facilitate disposal of waste liquid.

The apparatus is preferably cartlike, high enough at its bottom to clear the customarily low bowl of a toilet in a hospital or like facility, with supporting wheels spaced far enough apart laterally to straddle a substantial portion of such bowl, and with a brake to preclude wheel movement when collecting or discharging liquid.

Other objects of this invention together with means and methods for attaining the various objects will be apparent from the drawings and the accompanying description of a preferred inventive embodiment presented here to illustrate rather than to limit the invention.

SUMMARY OF THE DRAWINGS

FIG. 6 is a plan view of the control panel on the housing top.

FIG. 7 is a circuit diagram of electrical and fluid connections and flow paths for the apparatus of this invention and FIGS. 1 to 6.

DESCRIPTION OF THE INVENTION

Figure 1:
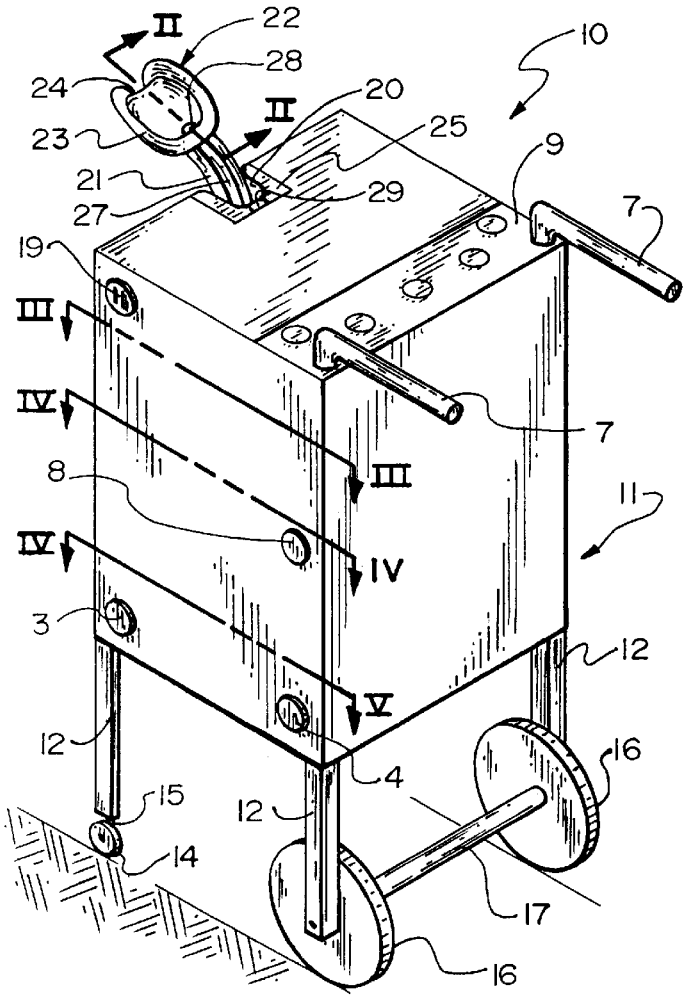
FIG. 1 is a perspective view of mobile repository apparatus for liquid waste disposal according to the present invention.

FIG. 1 shows, in perspective, from above and to the left rear, cartlike mobile sanitation apparatus 10 having housing 11 with four legs 12 (only three visible) at its respective bottom corners, pair of swivel wheels 14 on respective vertical pivot pins 15 in the front legs (only one visible) and pair of rear wheels 16 mounted on opposite inboard end portions of axle 17 retained via transverse bores in bottom ends of the rear legs. Electrical receptacle 19 is visible at the upper front portion, and rinse water filler valve 8 at a lower rear portion, of the housing left side. Pair of handles 7 curve upward and back from left and right rear corner portions of the flat top surface, with rectangular control panel 9 intervening.

The front edge of housing 11 is indented by rectangular slot 20 extending downward about half the housing front face (hidden here), into which fits waste liquid flexible tube 21 having on its visible end waste liquid receptor 22 with upturned cuplike edge wall 23 all around except for dip 24 at the far (front) end. The receptor is shown here in a partially extended out-of-slot position. The top edge of the slot is covered in part by U-shaped bezel 25, open at the front and with switch button 29 at the rear, on which receptor 20 rests when in its retracted position, with tube 21 in the slot.

Figure 2:
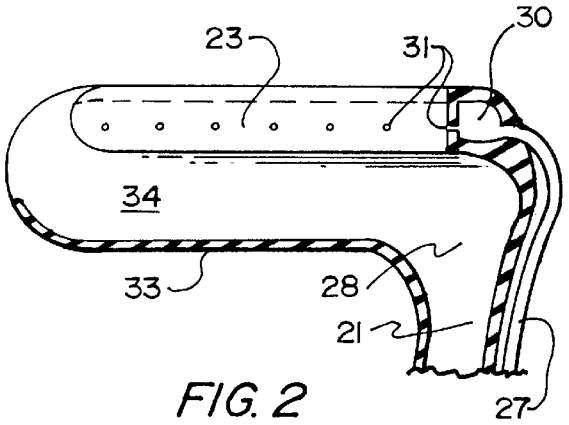
FIG. 2 is a side sectional elevation of the receptor component of the same apparatus, taken at II—II at FIG. 1 upper left part.

FIG. 2 shows, in medial side elevation, on an enlarged scale, receptor 22 on the top end of tube 21 in communication with outlet opening 28 at the near end of cuplike receptor bed 38—sectioned here and shaded for elastomer. (In general outline this view somewhat resembles an inverted golf putter head.) The receptor is open at the left and above. Hollow wall 23 overhangs inward from the far side (shown beyond the medial plane) and from the right (sectioned in the medial plane). Small tube 27 extending along the outer edge of larger drain tube 21 conducts rinse water to interior 30 of the wall, which is provided with small openings 31 from which the water can seep out and down to wash the receptor wall, bed, and drain.

Figure 3:
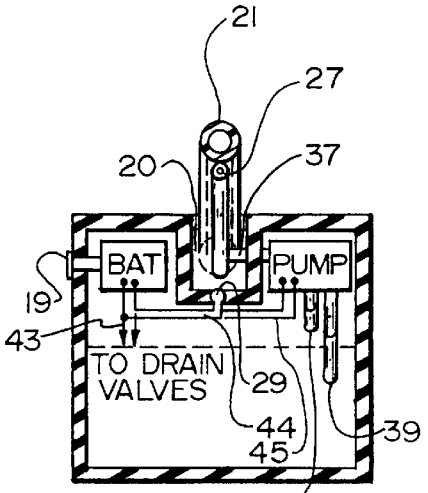
FIG. 3 is a sectional plan of the same apparatus, taken at a level just under the top cover of the housing, at III—III on FIG. 1.
Figure 5:
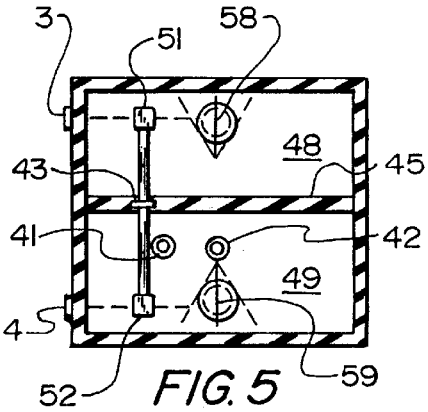
FIG. 5 is a similar sectional plan, taken just above the bottom of the housing, at V—V on FIG. 1.

FIG. 3 shows apparatus 10 in sectional plan, at a level just underneath the top of housing 11, with U-shaped indentation 20 facing the top of the sheet and with small rinse water tube 21 and large drain tube 27 extending forward therefrom. A dashed line bisects the underlying part of the housing into a front compartment and a rear compartment. At this level, battery BAT appears left of slot 20, and airpump PUMP appears right of the slot. The battery is connected to outside electrical receptacle 19 at the left wall. An intervening rectifier appears in a later circuit diagram. Leads 43 from the battery to drain valves (v. FIG. 5) appear fragmentarily here; leads 44 from the battery connect to switch button 29, and leads 45 from the battery connect to airpump PUMP. From the pump, drying air tube 37 connects to rinse water tube 29, pressure tube 38 connects to the underlying front (waste) compartment, and pressure tube 39 connects to the underlying rear (rinse water) compartment.

Figure 4:
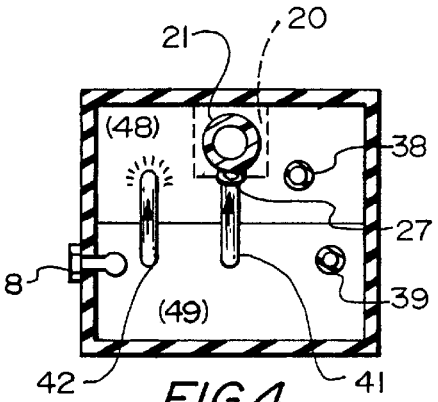
FIG. 4 is a similar sectional plan, taken at an intermediate level of the housing, at IV—IV on FIG. 1.

FIG. 4 shows apparatus 10 in sectional plan at the level of the covers for the underlying front and rear compartments (identified parenthetically as 48 and 49), and of the bottom end of waste liquid tube 21, ending just below the cover in the underlying waste liquid compartment. From the airpump shown previously, tube 38 extends just into the top of underlying waste liquid compartment (48), and similar tube 39 extends just into the top of underlying rinse water compartment (49). Rinse water filler valve 8 from the outer left rear corner also extends just down into the rinse water compartment.

Also in FIG. 4, tubes 41 and 42 rise from near the bottom of the rinse water compartment and upon pressurization thereof convey rinse water, (as indicated by arrows) to tube 27 to the waste liquid receptor, or to a spray head (suggested by short radiating lines) in the top part of the waste liquid compartment. The timing thereof is considered below during and after description of the control panel (FIG. 6) and related circuitry (FIG. 7).

FIG. 5 shows apparatus 10 in sectional plan at a level near the floor of housing 11. Transverse wall 45 of the housing separates waste liquid compartment 48 occupying the front part of the housing from rinse water compartment 49 in the rear part. The intake ends of tubes 41 and 42 at this level in the rear compartment enable airpump pressurization to force rinse liquid upward and out through one or another of those tubes as noted in the description of FIG. 4.

Also shown in FIG. 5 are leads 43 from the battery leading down through a vertical bore in wall 45 to actuator means 51 and 52 for respective drain valve means 58 and 59 (each as two half circles) in closed position at the bottom of respective compartments 48 and 49. Sequencing of the electrical valve actuators is considered below in description of another diagram. V-shaped mechanical drain actuating means for the waste liquid and rinse water compartments flare frontward and rearward, respectively, and are actuatable manually, as in the event of electrical failure, by pulling knob 3 at the left side near the front to drain the waste liquid (frequently), or knob 4 at the left side near the rear to empty the rinse water (rarely).

FIG. 6 shows, in plan, control panel 9 on a scale larger than it appeared in FIG. 1. Its lower left and right corners are filled by vertical portions of housing handles 8, whereas its other corners have knobs for switch S1 (CHARGE OFF-ON) at the upper left and switch S2 (POWER OFF-ON) at the upper right. The CHARGE switch may be ON to recharge the battery so long as an extension cord from an electrical outlet is plugged into receptacle 19 on the housing left side panel. Spaced left-to-right on the panel are knobs for OFF-ON switches S3 (RINSE), S4 (DRAIN), and S5 (FLUSH). As shown, normally in use the CHARGE switch is OFF, the POWER switch is ON, the RINSE switch is ON, and the DRAIN and FLUSH switches are OFF.

FIG. 7 shows, schematically, an example of electrical and fluid circuitry, in conjunction with illustrated preferred embodiment 10, including the switches whose knobs were designated in FIG. 6, shown here as set in the same positions as in that preceding view. At the upper left is external electrical receptacle 19 connected to the movable contactor of CHARGE switch S1, which is in the non-charging OFF position, while its ON terminal is connected to one of the input leads of rectifier RECT along with the receptacle second (neutral or grounded) lead. The pair of output leads from the rectifier connect as input to battery BAT, and one of the battery output leads is grounded, at one side of the electrical circuit, and the ungrounded other or hot lead continues throughout the circuit being described. Next below in this view, POWER switch S2 has its contactor set ON to connect to the battery output hot lead, which feeds through to pair of REST button 29 terminals bridged when receptor 22 is extended, as it is here. The alternative terminals of the REST button are blank.

To the right and up from the REST button is RINSE switch S2, in the ON position, connecting the hot lead to energize airpump PUMP in the DOWN output direction to pump air via tube 39 into the top of RINSE WATER compartment 49. The rising air pressure in compartment 48 forces water from it via tube 41, which leads mainly to tube 27 to receptor 22. Water seeping into the receptor rinses any waste liquid down via tube 21 down into WASTE LIQUID compartment 48. If the contactor of switch S3 is turned to DRY (an extraordinary position) the hot lead connects to the airpump in the UP output position to send air via line 41 from the airpump to the receptor via a short top portion of tube 27 (devoid of rinse water).

At the lower left in FIG. 7 is DRAIN switch S4, shown with its contactor in the OFF position. In the ON position it is enabled to energize actuator 51 connected to outlet valve 51 in the bottom of WASTE LIQUID compartment 48 to open outlet valve 58 and drain the contents, preferably into a toilet bowl or other suitable disposal site. If the switch S4 contactor is turned to EMPTY (extraordinary) outlet valve 59 of RINSE WATER compartment 49 is actuated similarly, also preferably over a toilet bowl or other suitable disposal site.

FIG. 7 also shows, that as already noted, knob 3 is connected to WASTE LIQUID compartment 48 outlet valve 58 to enable manual opening (and reclosing) of it without electrical assistance. Similarly, knob 4 is connected to RINSE WATER compartment 49 to enable manual opening and reclosing of it without electrical assistance.

FLUSH switch S5, shown in the normal OFF position at the upper right in FIG. 7, in its alternative ON position is effective to open valve in tube 37, branching off from rinse tube 41 and terminating in a spray head (indicated by radiating lines) in the top of WASTE LIQUID compartment 48 to enable it to be washed down at any time the RINSE switch is ON.

Operation of the apparatus of this invention is apparent from the drawings and the foregoing and following descriptive remarks. With the FIG. 6 switch knobs in their indicated normal settings, rinse water is provided to the receptor for personal waste liquid whenever and so long as the receptor is away from its rest position against the button on its bezel at the top edge of the slot in the upper portion of the front of the apparatus housing. Waste liquid deposited into the receptor at such time will tend to flow, along with seeping rinse liquid, from the receptor via its outlet opening down into the waste liquid compartment. Whenever the receptor is returned to its unextended position against the rest button, the rinsing flow is discontinued. When the RINSE knob is set at ON, the airpump outputs air down into the rinse water compartment to force the water up to rinse the receptor. Turning the RINSE knob past ON to DRY substitutes air (instead of rinse water) to the receptor, as is useful from time to time. Turning the middle or DRAIN switch knob to ON opens the waste liquid compartment drain valve, whereas turning it further to EMPTY alternatively opens the rinse liquid compartment drain valve. The waste liquid compartment may be washed down with rinse water by turning the FLUSH switch to the ON position. Of course, turning any switch OFF discontinues whatever function(s) it enables when in any other position(s), and turning the POWER switch OFF discontinues all operation, though turning the CHARGE switch ON at any time when a power cord is attached at the input receptacle will enable the battery to be charged.

The apparatus of this invention does not require any unusual materials or other components. The housing is preferably made of a rigid polymeric organic material, optionally laminated or foamed, such as nylon or PVC, but may be made of metal lined with some such polymeric or similar material unaffected by bodily fluids. Handles may be made of similar organic or metallic materials. The receptor is preferably made of natural or synthetic rubber, or other elastomeric polymeric composition, temporarily deformable without damage. Tubing materials abound, and any of the foregoing or other flexible materials, such as polyethylene or polypropylene, will suffice. Electrical receptacles, electrically operated airpumps, valves, rectifiers, and switches are readily available, as are hardware items, such as fasteners, wheels, and the like.

The dimensions of the apparatus of this invention are dictated by its functionality, including desired maneuverability by a single person within the confines of hospital aisles, corridors, and rooms. The empty weight of the apparatus should not exceed the weight of rinse water and waste liquid it holds, so that the the operator will have a reasonable choice between frequent draining to keep the weight low, or less frequent draining while handling more weight.

The apparatus of this invention is not only helpful to the people who spit or otherwise deposit waste liquid into the receptor, but also to those who tend to disposal of such waste liquids. It is more sanitary than prior practice, as using an airpump to produce liquid flow is highly preferable to exposing a liquid pump to contamination by waste liquid. Continual rinsing of the receptor while in actual use is similarly preferable to depositing waste liquid alone into a conventional container hand-carried to a disposal site, and emptied there, and washed there or elsewhere.

A preferred embodiment of the apparatus has been illustrated and described, with suggestions of adaptations or variants. Other means and methods of accomplishing the various objects may include addition, substitution, or other change in apparatus, composition, or method, while retaining many of the advantages of the invention, which itself is defined only in the following claims.

The claimed invention:

1. In a mobile sanitation apparatus having housing means, the improvement comprising temporarily deformable elastomeric receptor means for a patient's waste liquid, tubular means adapted to conduct the waste liquid from the receptor means into a temporary waste liquid storage compartment in the housing means, wherein the temporary storage compartment is at a height enabling it to be positionable over and be discharged into a toilet bowl as well as into an underlying conventional drain;

and rinse means for rinsing clean the waste liquid path from the receptor means into the storage compartment.

2. Improvement in mobile sanitation apparatus according to claim 1, including pumping means adapted to pump the rinse water to the receptor means, from which it drains into the temporary storage compartment.

3. Improvement in mobile sanitation apparatus according to claim 2, wherein the housing means includes a compartment of rinse water and wherein the pumping means forces air into that compartment to force the rinse liquid to the receptor means.

* * * * *